US006904257B2

(12) United States Patent
Tomatsu

(10) Patent No.: US 6,904,257 B2
(45) Date of Patent: Jun. 7, 2005

(54) IMAGE FORMING DEVICE CAPABLE OF CHANGING PRESSING FORCE BETWEEN FIXING MEMBERS

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/322,498

(22) Filed: Dec. 19, 2002

(65) Prior Publication Data

US 2003/0118382 A1 Jun. 26, 2003

(30) Foreign Application Priority Data

Dec. 20, 2001 (JP) ..... 2001-388323

(51) Int. Cl.[7] ..... G03G 15/20
(52) U.S. Cl. ..... 399/328
(58) Field of Search ..... 399/328, 330, 399/331, 332, 339, 122, 320

(56) References Cited

U.S. PATENT DOCUMENTS 4,392,739 A * 7/1983 Brown et al. ..... 399/332
4,753,543 A * 6/1988 Mochimaru et al. ..... 399/330
4,873,553 A * 10/1989 Inaba ..... 399/332
6,631,252 B2 * 10/2003 Ando et al. ..... 399/328

FOREIGN PATENT DOCUMENTS

| | | | | |
|---|---|---|---|---|
| JP | 57-115579 | * | 7/1982 | G03G/15/20 |
| JP | 62-027782 | * | 2/1987 | G03G/15/20 |
| JP | 63-309983 | * | 12/1988 | G03G/15/20 |
| JP | 02-135485 | * | 5/1990 | G03G/15/20 |
| JP | 04-063388 | * | 2/1992 | G03G/15/20 |
| JP | A 10-31378 | | 2/1998 | |
| JP | A 10-177314 | | 6/1998 | |
| JP | 10-282830 | * | 10/1998 | G03G/15/20 |
| JP | 2000-259029 | * | 9/2000 | G03G/15/20 |

* cited by examiner

*Primary Examiner*—Hoan Tran
(74) *Attorney, Agent, or Firm*—Oliff & Berridge, PLC

(57) ABSTRACT

When fixing images onto normal sheets of paper, the pressing force between a pressing roller and a thermal roller of a fixing unit is designated by the urging force of only a first spring. On the other hand, when fixing images onto thick sheets, the pressing force is designated by the urging force of the first spring and the urging force of a second spring, which operates against the urging force of the first spring.

16 Claims, 10 Drawing Sheets

33

60

IMAGE FORMING DEVICE CAPABLE OF CHANGING PRESSING FORCE BETWEEN FIXING MEMBERS

BACKGROUND OF THE INVENTION

1. Field of the Invention

The present invention relates to an image forming device and particularly to an image forming device with a mechanism for adjusting pressing force between fixing members.

2. Description of the Related Art

A conventional image forming device, such as a laser printer, normally includes a process cartridge and a fixing unit. The process cartridge is for transferring toner images from a photosensitive drum onto a sheet at the time of when the sheet passes between the photosensitive drum and a transfer roller. The fixing unit is located downstream from the process cartridge in the direction that the sheet is transported, and includes a thermal roller and a pressing roller disposed in pressing contact with each other. While the sheet passes between the thermal roller and the pressing roller, heat from the thermal roller fuses the transferred toner image onto the sheet.

Sometimes a user will want to form an image on an envelope or other sheet that is thicker than a normal print sheet. Some fixing units include a switching mechanism that can reduce pressing force of the pressing roller against the thermal roller from the pressure used on a normal print sheet when such a thick sheet is to be printed on.

One such switching mechanism includes two springs for each end of the pressing roller, i.e., a total of four springs. When a thick sheet is to be printed on, then the switching mechanism switches urging force of these four springs to press the pressing roller against the thermal roller.

Another switching mechanism includes a support member that swingably supports the pressing roller and a spring that constantly urges the pressing roller to press against the thermal roller. A rod member can be freely protruded in and out to abut against the support member by an amount that depend on the thickness of the sheet to be printed on in order to switch the pressing force.

SUMMARY OF THE INVENTION

However, the fixing unit that includes the switching mechanism with four springs can show great variation in pressing force. That is, because four springs are used to urge the pressing roller against the thermal roller, any variation in the urging force of the springs greatly influences the pressing force of the pressing roller against the thermal roller. Any variation in pressing force is almost constantly a problem for the user, because the four springs are used even in the most commonly used printing mode of the image forming device, that is, when normal sheets are printed on.

The switching mechanism that abuts the rod member against the support member also has room for improvement. That is, the stroke of the rod member protruding in and out can vary because of assembly errors or tolerance levels allowed in production of components. For this reason, the pressing force of the pressing roller against the thermal roller when fixing an image on a thick sheet can vary among printers even to a greater extend than in the switching mechanism with four springs.

It is an objective of the present invention to overcome the above-described problems and to provide an image forming device capable of reducing variation in pressing force between fixing members.

In order to achieve the above and other objects, according to the present invention, there is provided an image forming device including a fixing unit and a pressing force adjusting mechanism. The fixing unit includes two fixing members disposed in pressable confrontation with each other, and fixes images onto a recording medium sandwiched between the fixing members. The pressing force adjusting mechanism adjusts pressing force applied between the fixing members and includes a first urging unit that urges the fixing members to press against each other and a second urging unit including a first resilient member that produces urging force that reduces the pressing force between the fixing members against urging force of the first urging unit. The second urging unit is switchable between an operating mode wherein urging force of the first resilient member operates to reduce the pressing force between the fixing members and a non-operating mode wherein the urging force of the first resilient member does not operate to reduce the pressing force between the fixing members.

There is also provided an image forming device including a casing, a fixing unit, a pressing force adjusting mechanism, and a first cover. The fixing unit includes two fixing members disposed in pressable confrontation with each other, and fixes images onto a recording medium sandwiched between the fixing members. The pressing force adjusting mechanism includes a pressing member that selectively applies a predetermined pressing force and a smaller pressing force between the fixing members, and a switching member that switches the pressing member between a first pressing condition for applying the predetermined pressing force between the fixing members and a second pressing condition for applying the smaller pressing force between the fixing members. The first cover selectively opens up and covers interior of the casing. The first cover in the opened-up condition enables the recording medium to be linearly transported from the fixing unit out of the casing. The first cover abuts against the switching member when closing from the opened-up condition, thereby switching member switching the pressing member from the second pressing condition to the first pressing condition.

BRIEF DESCRIPTION OF THE DRAWINGS

In the drawings:

FIG. 11(*b*) is a cross-sectional view showing a switching member in a position between the non-operating condition and the operating condition; and FIG. 11(*c*) is a cross-sectional view showing the switching member in the operating condition.

DETAILED DESCRIPTION OF THE EMBODIMENT

Next, a laser printer 1 will be explained as an embodiment of an image forming device according to the present invention.

Figure 1:
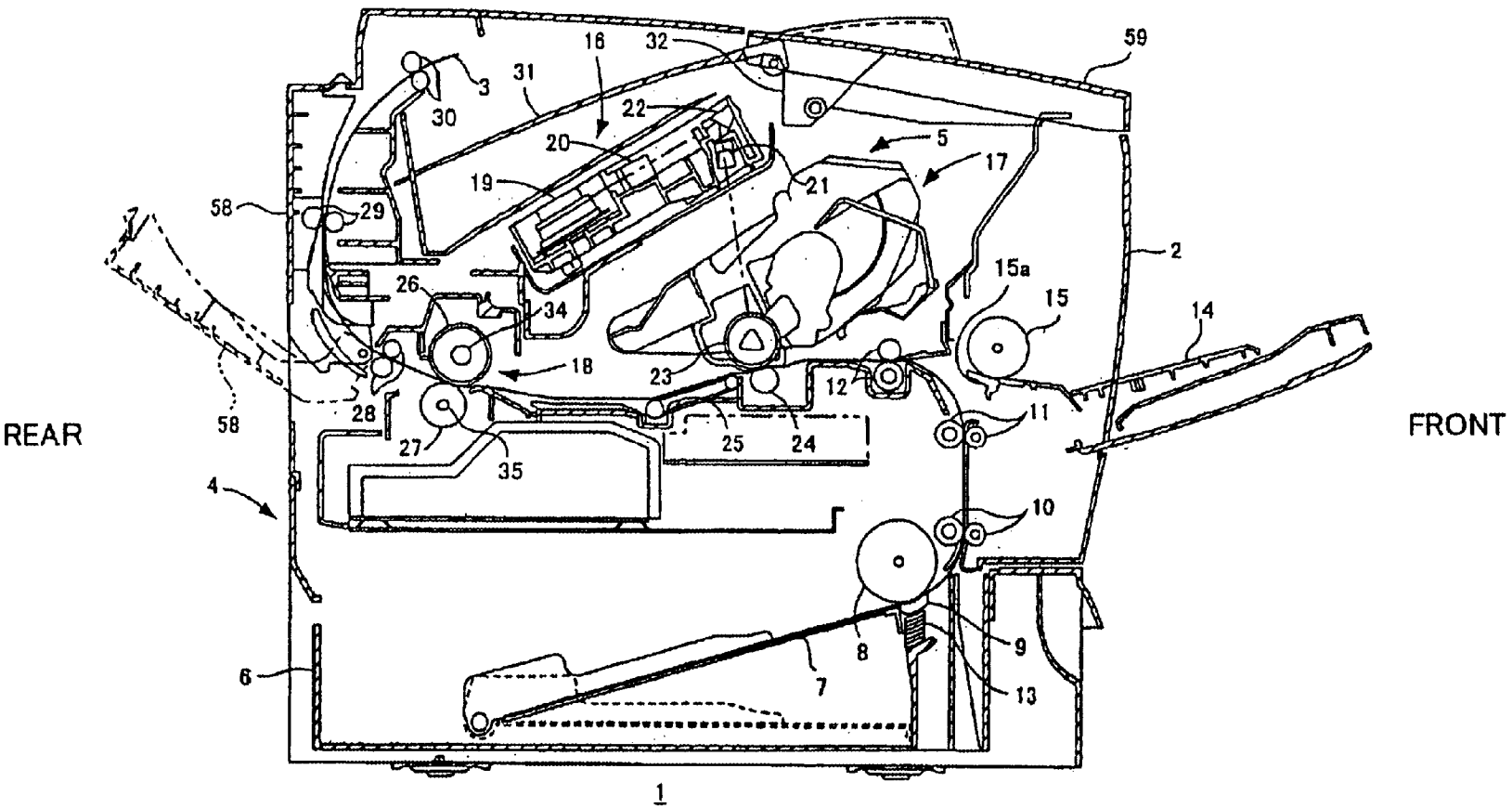
FIG. 1 is a cross-sectional side view of a laser printer according to an embodiment of the present invention.

As shown in FIG. 1, the laser printer 1 includes a casing 2, a feeder unit 4, and an image forming unit 5. The feeder unit 4 feeds sheets 3 one at a time to the image forming unit 5, which forms images on the sheets 3.

The feeder unit 4 includes a sheet tray 6, a pressing plate 7, a sheet feed roller 8, a sheet feed pad 9, transport rollers 10, 11, and register rollers 12. The sheet tray 6 is detachably mounted to the interior of the base of the casing 2. The pressing plate 7 is provided within the sheet tray 6. The sheet feed roller 8 and the sheet feed pad 9 are provided above the front end of the sheet tray 6. The transport rollers 10, 11 are provided downstream from the sheet feed roller 8 with respect to a sheet transport direction in which sheets 3 are transported. The register rollers 12 are provided further downstream from the transport rollers 10, 11 in the sheet transport direction.

The pressing plate 7 is stacked with a plurality of sheets. The pressing plate 7 is swingably supported about its rear side so that its free front side can swing vertically up and down. Although not shown in the drawings, a spring is provided below the pressing plate 7 that urges the pressing plate 7 upward. As a result, the upper most sheet of the stack on the pressing plate 7 is pressed against the sheet feed roller B. The pressing plate 7 swings about the rear side as the pivot point, downward under the weight of the stacked sheets against the urging force of the spring. The sheet feed roller 8 and the sheet feed pad 9 are located in confrontation with each other. A spring 13 provided on the bottom surface of the sheet feed pad 9 presses the sheet feed pad 9 toward the sheet feed roller 8. When the sheet feed roller 8 rotates, the uppermost sheet 3 on the pressing plate 7 is sandwiched between the sheet feed roller 8 and the sheet feed pad 9 and fed in the sheet transport direction. Sheets 3 fed one at a time in this way are transported to the register rollers 12 by the transport rollers 10, 11. The register rollers 12 subject the sheet 3 to a resist operation and then transport the sheet 3 to the image forming unit 5.

The feeder unit 4 further includes a multipurpose tray 14, a multipurpose side sheet feed roller 15, and a multipurpose side sheet feed pad 15*a*. The multipurpose side sheet feed roller 15 and the multipurpose side sheet feed pad 15*a* are disposed in confrontation with each other. Although not shown in the drawings, a spring is disposed to the rear of the multipurpose side sheet feed pad 15*a* for pressing the multipurpose side sheet feed pad 15*a* toward the multipurpose side sheet feed roller 15. Sheets stacked on the multipurpose tray 14 are sandwiched one at a time between the multipurpose side sheet feed roller 15 and the multipurpose side sheet feed pad 15*a* by rotation of the multipurpose side sheet feed roller 15 and then fed to the register rollers 12.

The image forming unit 5 includes a scan unit 16, a processes cartridge 17, a transfer roller 24, and a fixing unit 18. The scan unit 16 is provided inside the upper portion of the casing 2 and includes a polygon mirror 19, lenses 20, 21, a reflection mirror 22, and a laser emitting section (not shown). The laser emitting section emits a laser beam based on image data. As indicated by a two-dotted chain line in FIG. 1, the laser beam reflects off the polygon mirror 19, passes through the lens 20, reflects off the reflection mirror 22, and passes through the lens 21, in this order, and scans across the surface of a photosensitive drum 23 (described later) of the processes cartridge 17 at a high speed.

The processes cartridge 17 is mounted below the scan unit 16 so as to be detachable from the casing 2. The processes cartridge 17 includes the photosensitive drum 23, and, although not shown in the drawings, a scorotoron charge unit, a developing roller, and a toner holding section. The toner holding section is filled with positively charging, non-magnetic, single component, polymerized toner as developing agent. The toner is borne in a thin layer with a fixed thickness on the developing roller.

The photosensitive drum 23 is rotatably disposed in confrontation with the developing roller. The main drum of the photosensitive drum 23 is connected to ground. The surface of the photosensitive drum 23 is formed from a positively charging photosensitive layer, such as polycarbonate.

As the photosensitive drum 23 rotates, the scorotoron charge unit charges the surface of the photosensitive drum to a uniform positive charge. Then, the surface is selectively exposed by the high-speed scan of the laser beam from the scan unit 16. The electric potential of the charge drops when exposed by the laser beam, thereby forming an electrostatic latent image based on the image data. When the electrostatic latent image comes into confrontation with the development roller, the positively charged toner borne on the development roller is selectively supplied onto the surface of the photosensitive drum 23. In this way, the toner develops the electrostatic latent image into a visible toner image.

The transfer roller 24 is disposed below the photosensitive drum 23. The transfer roller 24 is supported rotatable on the casing 2 in confrontation with the photosensitive drum 23. The transfer roller 24 includes a metal roller shaft covered with a roller made from conductive rubber. A predetermined transfer bias is applied between the transfer roller 24 and the photosensitive drum 23. For this reason, the visible toner image borne on the photosensitive drum 23 is transferred to the sheet 3 as the sheet 3 passes between the photosensitive drum 23 and the transfer roller 24. The sheet 3 with the visible toner image is transported to the fixing unit 18 by a transport belt 25.

The fixing unit 28 is disposed downstream from the processes cartridge 17 in the sheet transport direction and includes a thermal roller 26 and a pressing roller 27 disposed in confrontation with the thermal roller 26. The thermal roller 26 is made from a metal roller, and includes a halogen lamp to heat up the metal roller. The thermal roller 26 is rotatably supported on a roller shaft 34, which is fixed inside the casing 2. The pressing roller 27 is supported on a roller shaft 35 and presses toward the thermal roller 26. With this configuration, the fixing unit 18 thermally fixes toner images onto sheets 3 while the sheets 3 pass between the thermal roller 26 and the pressing roller 27.

Transport rollers 28, 29 are provided downstream from the fixing unit 18 for transporting sheets 3 that are discharged from the fixing unit 18 to sheet-discharge rollers 30. The discharge rollers 30 discharge the sheets 3 onto a discharge tray 31.

Figure 7:
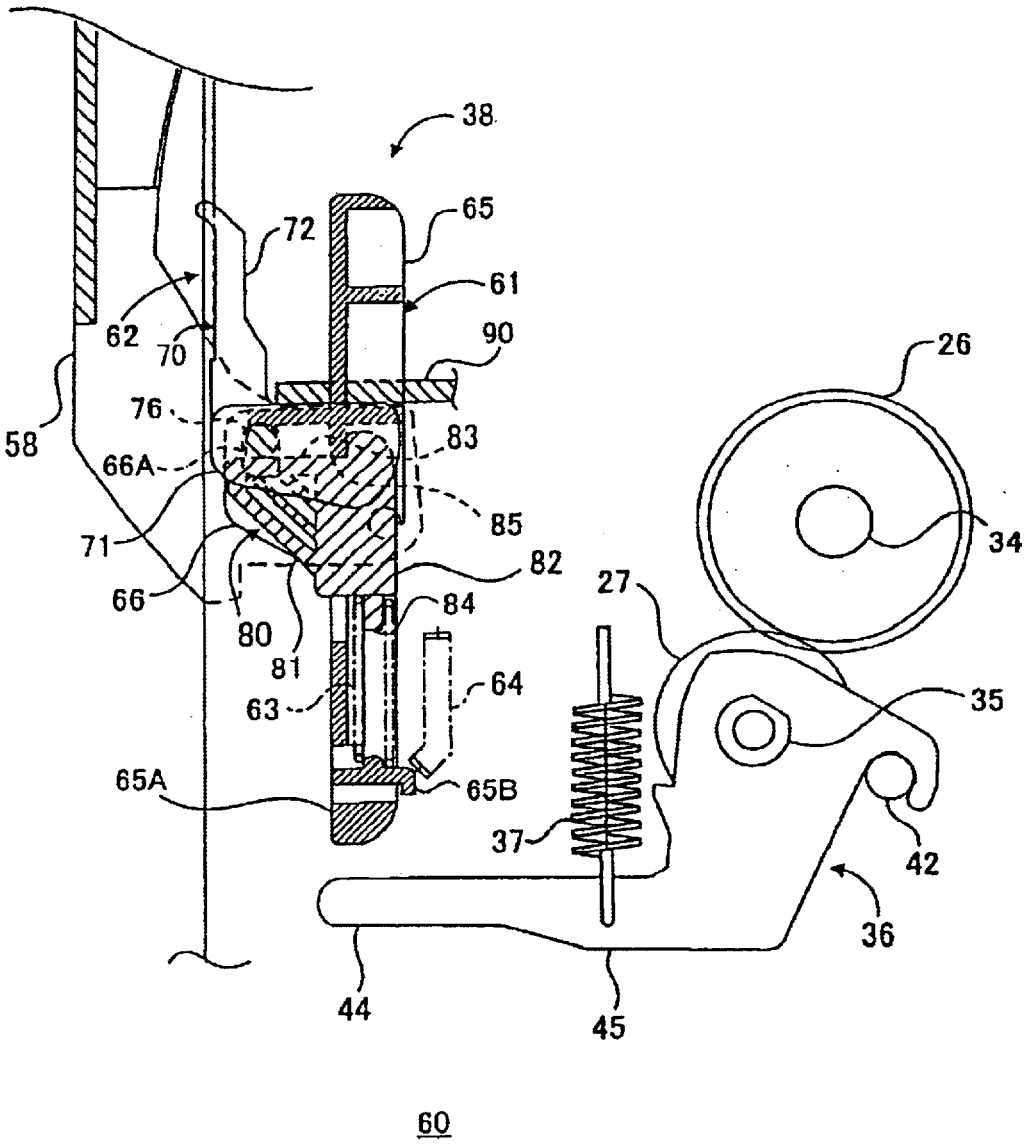
FIG. 7 is a magnified side view showing essential components of a pressing force adjusting mechanism of the laser printer of FIG. 1 with a rear cover in a closed condition and a second lever in a non-operating condition.

A rear cover 58 is provided freely openable at the rear side of the casing 2. A top cover 59 is provided freely openable at the top of the casing 2. The rear cover 58 is formed separately from the top cover 59 and is freely swingable around its lower end. When the rear cover 58 is opened up as indicated by two-dot chain line in FIG. 1, a "straight" path is formed that enables sheets 3 to be discharged following a substantially linear path from the fixing unit 18. Also, a first operation lever 46 shown in FIG. 2 and a second operation lever 72 shown in FIG. 7 are exposed to manipulation by an operator from outside the casing 2. Accordingly, the first operation lever 46 and the second operation lever 72 are easier to use.

The top cover 59 is pivotably supported about its rear-side end above the processes cartridge 17. The top cover 59 is pivotable from a closed portion shown in FIG. 1 and an opened position shown in FIG. 3. In the closed position, the top cover 59 is disposed in substantially a horizontal orientation that closes the casing 2. In the opened position, the top cover 59 extends upward and the casing 2 is opened. By opening and closing the top cover 59 in between these two positions, the processes cartridge 17 can be easily exchanged and the processes cartridge 17 can be easily removed to facilitate correction of paper jams. Also, an attachment plate 32 is formed in a downward protruding shape at the rear end of the top cover 59.

Figure 2:
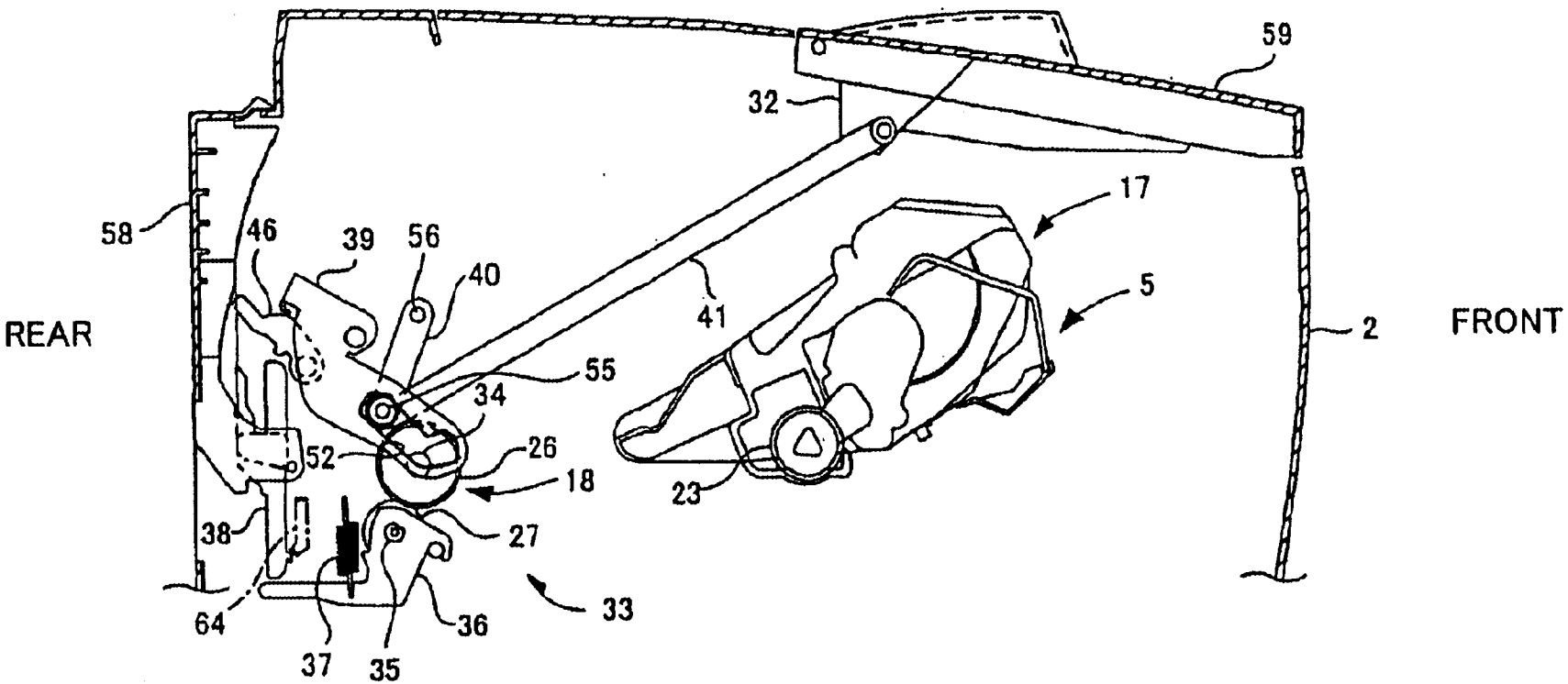
FIG. 2 is a cross-sectional side view showing essential configuration of a linking mechanism in the laser printer of FIG. 1 with a top cover of the laser printer closed.

The laser printer 1 further includes a linking mechanism 33 shown in FIG. 2 and a pressure changing mechanism 60 shown in FIG. 7. The linking mechanism 33 operates in linked association with closing and opening movement of the top cover 59 to press the pressing roller 27 against the thermal roller 26 when the top cover 59 is closed and not press against the thermal roller 26 when the top cover 59 is opened. The pressure changing mechanism 60 changes the pressing force between the pressing roller 27 and the thermal roller 26.

The configuration of the linking mechanism 33 will be explained. As shown in FIG. 2, the linking mechanism 33 includes a roller support member 36, a first spring 37, a linear movement rod 38, the first operation lever 46, a link member 39, a support plate 40, and a connection rod 41. Although not shown in the drawings, the linking mechanism 33 including all of the components listed above is provided on both sides of the fixing unit 18. Because both of the linking mechanisms 33 have exactly the same configuration, the linking mechanism 33 shown in FIG. 2 will be explained as a representative example.

Figure 4:
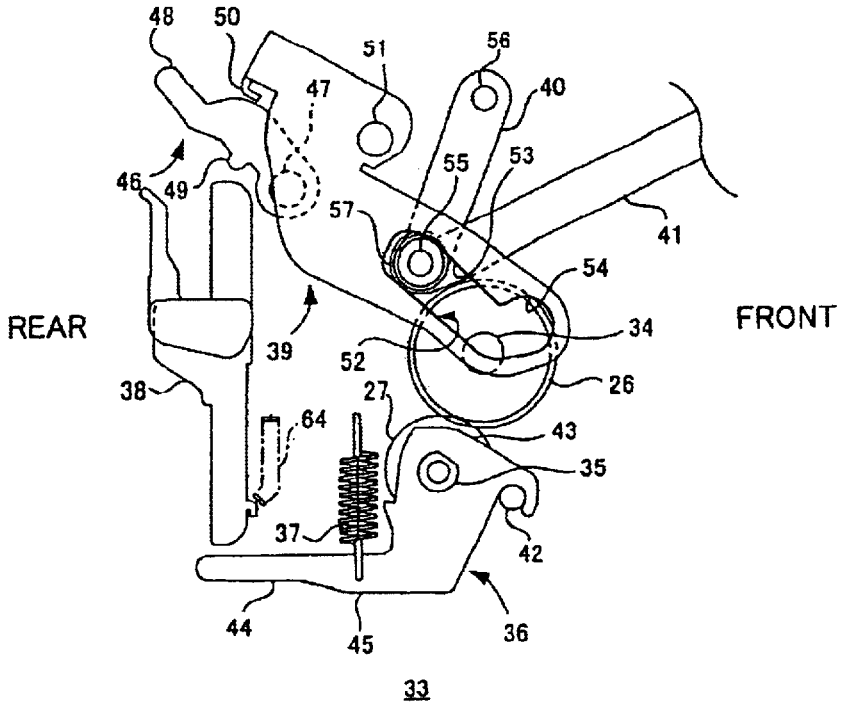
FIG. 4 is a magnified side view showing essential components of the linking mechanism of FIG. 3 with the top cover of the laser printer closed.

As shown in FIG. 4, the roller support member 36 is positioned under the thermal roller 26 and at the widthwise side of the pressing roller 27. The front end of the roller support member 36 is swingably supported on the casing 2 about a support shaft 42. The roller support member 36 is formed from an integral bearing portion 43 and an abutment lever 44. The bearing portion 43 is provided to the rear of the support shaft 42. The abutment lever 44 protrudes rearward from the bearing portion 43. Also, the roller shaft 35 of the pressing roller 27 is rotatably supported on the bearing portion 43.

The first spring 37 is attached at its lower end to a base 45 of the abutment lever 44 and at its upper end to the casing 2 at a position substantially directly above the base 45. The first spring 37 urges the base 45 upward. With this configuration, the roller support member 36 is urged by the first spring 37 to pivot clockwise, as viewed in FIG. 4, around the support shaft 42 so that the pressing roller 27 presses against the thermal roller 26.

The linear movement rod 38 is supported on the casing 2 at a position above the abutment lever 44 and in a substantially vertical orientation so as to be freely slidable up and down between an upper position and a lower position. The linear movement rod 38 is constantly urged upward by a suspension spring 64 so that the linear movement rod 38 is normally maintained in the upper position shown in FIG. 4.

The first operation lever 46 has a plate shape and is disposed above the linear movement rod 38. The front end of the first operation lever 46 is swingably supported on the casing 2 through a support shaft 47, which is provided near the front side of the upper end of the linear movement rod 38. The rear end of the first operation lever 46 serves as an operation lever 48, which users can manually manipulate in a manner to be described later. An abutment protrusion 49 is formed on the lower surface of the first operation lever 46, at a position between the support shaft 47 and the operation lever 48. The abutment protrusion 49 protrudes downward and is for abutting against the upper end of the linear movement rod 38 in a manner to be described later.

Figure 5:
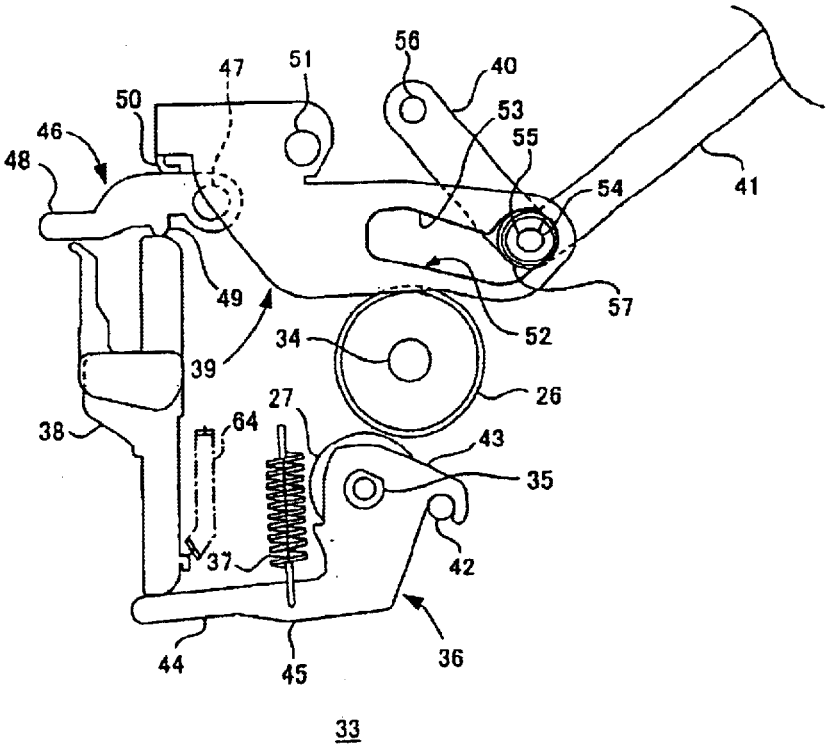
FIG. 5 is a magnified side view showing essential components of the linking mechanism of FIG. 2 with the top cover of the laser printer opened up.

When the linear movement rod 38 is retracted into its upper position as shown in FIG. 4, the lower end of the linear movement rod 38 is separated from the abutment lever 44. Therefore, the pressing roller 27 is maintained in the pressing position in pressing abutment with the thermal roller 26 by urging force of the first spring 37. On the other hand, when the first operation lever 46 is swung downward about the support shaft 47 as shown in FIG. 5, then the abutment protrusion 49 presses down on the upper end of the linear movement rod 38 so that the linear movement rod 38 moves into its downward position against the urging force of the suspension spring 64. As a result, the lower end of the linear movement rod 38 presses the abutment lever 44 downward. This swings the roller support member 36 against the urging force of the first spring 37 counterclockwise as viewed in FIG. 5 around the support shaft 42 so that the pressing roller 27 moves into its non-pressing position separated from the thermal roller 26. That is, the pressing roller 27 can be selectively moved between the pressing position and the non-pressing position with respect to the thermal roller 26 by swinging movement of the roller support member 36 generated when the linear movement rod 38 is advanced and retracted. With this configuration, when the user presses the operation lever 48 of the first operation lever 46 downward, then the pressing roller 27 moves to its non-pressing position.

The support plate 40 has a substantially rectangular plate shape and is disposed in a substantially vertical orientation. The support plate 40 is formed on one end with an engagement protrusion 55 and at the other end is swingably supported with respect to the casing 2 by a support shaft 56.

The link member 39 has a plate shape and is disposed above the roller support member 36 separated from the roller support member 36 by a predetermined distance. The link member 39 is swingably supported on the casing 2 by a support shaft 51 at an upper portion of the link member 39 near the lengthwise center of the link member 39. A pressing protrusion 50 is provided to the lower surface of the link member 39 at its rear-side end. The pressing protrusion 50 is for abutting against the upper surface of the first operation lever 46 so as to press the linear movement rod 38 downward via the first operation lever 46. A guide groove 52 is formed in the link member 39 from near the lengthwise center of the link member 39 to the front of the link member 39. The guide groove 52 is elongated slot shaped substantially like the letter "L." The guide groove 52 is for receiving the engagement protrusion 55 and allowing the engagement protrusion 55 to move following the swinging direction of the support plate 40.

In more concrete terms, the guide groove 52 includes a movement groove portion 53 and a lock groove portion 54. The lock groove portion 54 is opened to connect with the movement groove portion 53. The movement groove portion 53 is formed in the shape of an elongated slot so as to enable movement of the engagement protrusion 55. The lock groove portion 54 is formed to extend in a slant upward with respect to the lengthwise direction of the movement groove portion 53. The upward slant is the direction for reducing force for swinging the link member 39 when the top cover 59 is being opened up as will be described later and is the direction that the engagement protrusion 55 moves after surpassing the fulcrum position shown in FIG. 6 when moving in the guide groove 52 in association with swinging movement of the support plate 40.

The support shaft 56 of the support plate 40 is positioned above and to the front of the guide groove 52 so that, when the top cover 59 is in the closed condition, the support plate 40 is oriented to extend in a direction substantially perpendicular to the direction in which the guide groove 52 extends.

A roller member 57 is freely rotatably provided on the engagement protrusion 55 for reducing resistance to swinging between the engagement protrusion 55 and the guide groove 52.

Figure 3:
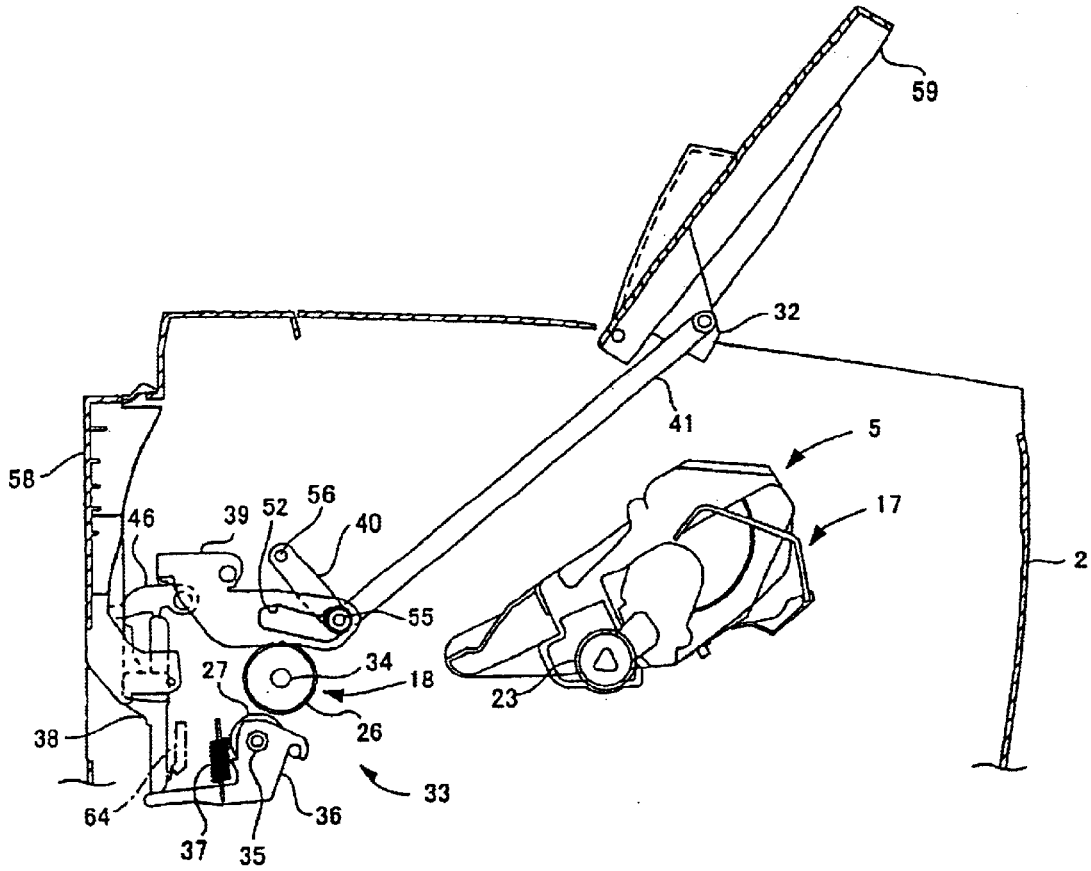
FIG. 3 is a cross-sectional side view showing essential configuration of the linking mechanism with the top cover of the laser printer opened up.

As shown in FIGS. 2 and 3, the connection rod 41 has the shape of a rod. The front end of the connection rod 41 is pivotably attached on the attachment plate 32 of the top cover 59. The rear end of the connection rod 41 is pivotally attached to the lower end of the support plate 40. The connection rod 41 is disposed so as to intersect the movement direction of the guide groove 52 when the link member 39 swings while the top cover 59 is being opened up and so as to extend to outside of the swinging path of the link member 39.

Next, operations of the linking mechanism 33 will be described. As shown in FIG. 2, the rear-side end of the connection rod 41 is in its rearmost position when the top cover 59 is in its closed up condition. Therefore, the support plate 40 is located where it is swung rearward, that is, clockwise, around the support shaft 56. The engagement protrusion 55 is located at the rear-side end of the movement groove portion 53 of the link member 39. As shown in FIG. 4, in this condition the link member 39 has swung clockwise around the support shaft 51 so that the guide groove 52 side of the link member 39 faces downward and the pressing protrusion 50 side of the link member 39 faces upward. As a result, the pressing protrusion 50 is separated from the upper surface of the first operation lever 46. Therefore, the first operation lever 46 does not press against the linear movement rod 38. For this reason, the linear movement rod 38 is in its retracted condition where it does not press the abutment lever 44 of the roller support member 36. Therefore, as described above the roller support member 36 maintains the pressing roller 27 in the pressing position under the urging force of the first spring 37. In this way, while the top cover 59 is in its closed up condition, the pressing roller 27 presses against the thermal roller 26.

Figure 6:
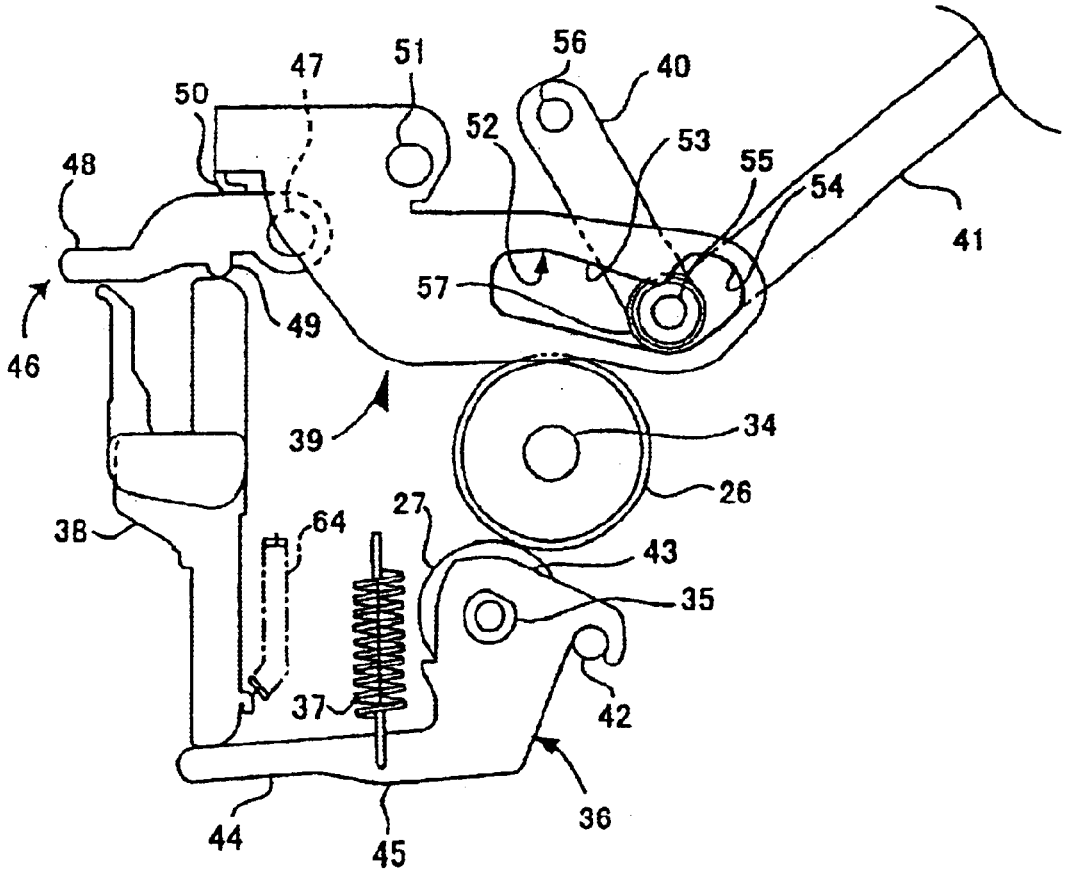
FIG. 6 is a magnified side view showing essential components of the linking mechanism of FIG. 2 with the top cover at a position between being opened up and closed.

When the top cover 59 is moved into its opened up condition shown in FIG. 3, the connection rod 41 moves forward in linking association with the opening movement of the top cover 59. In association with this, the rear-side end of the connection rod 41 moves forward as shown in FIG. 6. As a result, the support plate 40 swings counterclockwise forward around the support shaft 56 so that the engagement protrusion 55, which is engaged in the movement groove portion 53 of the guide groove 52, moves forward in the lengthwise direction of the movement groove portion 53. Therefore, the link member 39 swings counterclockwise around the support shaft 51, the guide groove 52 side of the link member 39 moves upward, that is, in the direction toward the support shaft 56, and the pressing protrusion 50 side of the link member 39 swings downward.

As a result, the pressing protrusion 50 of the link member 39 presses down on the upper surface of the first operation lever 46 so that, in the same way as when the operation lever 48 of the first operation lever 46 is pressed downward by a user, the first operation lever 46 swings in the counterclockwise direction around the support shaft 47, thereby pressing the linear movement rod 38 downward to press the abutment lever 44. Therefore, the pressing roller 27 moves into its non-pressing position so that pressure is no longer applied by the pressing roller 27 to the thermal roller 26.

When the top cover 59 is fully opened up as shown in FIG. 3, then as shown in FIG. 5 the engagement protrusion 55 of the support plate 40 is received within the lock groove portion 54 of the guide groove 52 so that movement of the engagement protrusion 55 is properly regulated. For this reason, when the top cover 59 is fully opened up, the pressing roller 27 is reliably maintained in its non-pressing position against the urging force of the first spring 37.

On the other hand, when the top cover 59 is closed from its opened condition, the top cover 59 presses down on the connection rod 41 so that the rear-side end of the connection rod 41 moves rearward. As a result, the support plate 40 swings clockwise to the rear around the support shaft 56. This pulls the engagement protrusion 55 out from the lock groove portion 54 and moves the engagement protrusion 55 following the swinging direction of the support plate 40 in the movement groove portion 53 to the rear-side end. For this reason, the link member 39 swings in the clockwise direction around the support shaft 51. As a result, the pressing protrusion 50 of the link member 39 stops pressing down on the upper surface of the first operation lever 46. Therefore, the pressing roller 27 presses against the thermal roller 26 while the top cover 59 is closed up.

Because pressing force of the pressing roller 27 against the thermal roller 26 can be released by opening the top cover 59, the user can easily remove a sheet 3 that is jammed between the pressing roller 27 and the thermal roller 26 by merely opening the top cover 59. Also, after removing the jammed sheet 3, the user needs to merely close the top cover 59 to press the pressing roller 27 against the thermal roller 26 so that fixing operations can be simply and reliably performed.

Although the opening movement of the top cover 59 presses the link member 39 down on the linear movement rod 38 through the first operation lever 46 against the urging force of the first spring 37, the load that is transmitted to the link member 39 by the urging force of the first spring 37 is transmitted in the swinging direction of the link member 39, that is, toward the support shaft 56. However, as described previously, the support plate 40 extends in a direction that is substantially perpendicular with the direction in which the guide groove 52 extends. Therefore, the load can be reliably received by the support plate 40. Further, because the connection rod 41 is disposed in an orientation so as to extend in a direction that intersects with the support plate 40 and to the outside of the swinging path of the link member 39, only an extremely small load will be transmitted to the top cover 59 through the connection rod 41. Moreover, because closing movement of the top cover 59 stops the link member 39 from pressing the linear movement rod 38, the load is not transmitted through the link member 39 to the top cover 59.

For this reason, the pressing roller 27 can be pressed against and separated from the thermal roller 26 in association with closing and opening movement of the top cover 59, while also reducing the amount of the resultant load that is transmitted to the top cover 59. Therefore, the top cover 59 does not need to be made particularly strong. The top cover 59 can be made with a simple and light configuration so that costs can be reduced. Also, there is no need to produce a force equivalent to the load when opening and closing the top cover 59. The top cover 59 can be opened easily with a simple force.

Moreover, when the top cover 59 is being opened up and closed, the support plate 40 swings in association with the opening or closing movement so that the engagement protrusion 55 slides within the guide groove 52. This insures that the link member 39 can be more reliably swung so that the associated load can be reliably prevented from being transmitted to the top cover 59.

The lock groove portion 54 is formed at an angle with respect to the movement groove portion 53 to reduce force for swinging the link member 39 when the top cover 59 is being opened up. Therefore, when the top cover 59 is being closed shut, the engagement protrusion 55 can be moved into the movement groove portion 53 of the guide groove 52 by merely applying force for moving the engagement protrusion 55 from the lock groove portion 54 to the movement groove portion 53, that is, force sufficient to move the engagement protrusion 55 over the fulcrum point shown in FIG. 6. Accordingly, opening and closing operations of the top cover 59 can be performed using even less force.

Moreover, because the roller member 57 is rotatably provided on the engagement protrusion 55 in order to reduce resistance to the sliding between the guide groove 52 and the engagement protrusion 55, the engagement protrusion 55 can be moved within the guide groove 52 with resistance to sliding reduced by the roller member 57. Accordingly, opening and closing operations of the top cover 59 can be performed using even less force.

Because the first operation lever 46 is provided as a member separated and independent from the link member 39, if a sheet 3 become jammed between the pressing roller 27 and the thermal roller 26, the sheet 3 can be easily removed without opening up the top cover 59, but by opening the rear cover 58 as indicated in FIG. 1 and pulling the first operation lever 46 by hand to release pressure between the pressing roller 27 and the thermal roller 26. That is, when a sheet 3 jams between the thermal roller 26 and the pressing roller 27, the user can reach the paper Jam by either opening up the top cover 59 or by operating the first operation lever 46. Because the user has a choice on how to remove the sheet 3, the device is more easily to repair.

Because the first operation lever 46 is swingably provided between the pressing protrusion 50 of the link member 39 and the linear movement rod 38, the first operation lever 46 can be provided in a simple and inexpensive configuration.

It should be noted that although the embodiment describes the first operation lever 46 as being swingably provided between the linear movement rod 38 and the pressing protrusion 50 of the link member 39, the first operation lever 46 can be dispensed with so that the pressing protrusion 50 of the link member 39 presses directly against the linear movement rod 38.

In this case, for example, the link member 39 and the linear movement rod 38 could be formed integrally together so that the link member 39 and the linear movement rod 38 configure a single pressing member. Alternatively, the pressing member configured from the integral linear movement rod 38 and the link member 39 could be formed integrally with the roller support member 36 to configure a single movement member from the link member 39, the linear movement rod 38, and the roller support member 36.

Next, the pressure changing mechanism 60 for changing pressing force of the pressing roller 27 onto the thermal roller 26 will be described in detail. It should be note that the same pressure changing mechanism 60 shown in FIGS. 7 to 11 is provided on both sides of the fixing unit 18. However, only the pressure changing mechanism 60 shown in FIGS. 7 to 11 will be described as a representative example to simplify explanations.

As shown in FIG. 7, the pressure changing mechanism 60 includes the above described roller support member 36, the first spring 37 and the linear movement rod 38. The linear movement rod 38 includes a linear movement rod 61, a switch 62, a second spring 63, and the suspension spring 64.

The linear movement rod 61 includes a linear motion member 65 and a protrusion portion 66. The linear motion member 65 has a long thin plate shape. An abutment portion 65A is formed on the lower end of the linear motion member 65. A hook-shaped holding protrusion 65B is formed on the front side of the abutment portion 65A. The protrusion portion 66 is formed integrally with the linear motion member 65 and protrudes rearward from the substantial lengthwise center of the linear motion member 65. The protrusion portion 66 is formed in a substantial rectangular shape with a downward slant at the lower section. The protrusion portion 66 is formed form a pair of plate members disposed in confrontation with each other and separated by a predetermined space. Also, a slot 66A is formed through the rear-end section of the protrusion portion 66 to extend downward following the lengthwise direction of the linear motion member 65.

The switch 62 includes a switching member 70 and a slide member 80. The switching member 70 is formed in an L-shape as viewed from the side and includes an integrally formed abutment plate 71 and a second operation lever 72. A swing shaft 76 of the abutment plate 71 is pivotably supported in the slot 66A of the linear movement rod 61. By this, the switching member 70 is swingably supported on the linear movement rod 61.

Figure 11A:
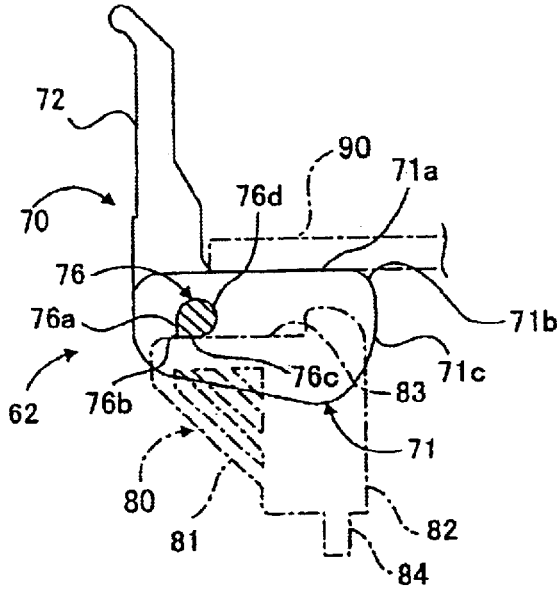
FIG. 11(*a*) is a cross-sectional view showing the pressing force adjusting mechanism of FIG. 7 in the non-operating condition.
Figure 11B:
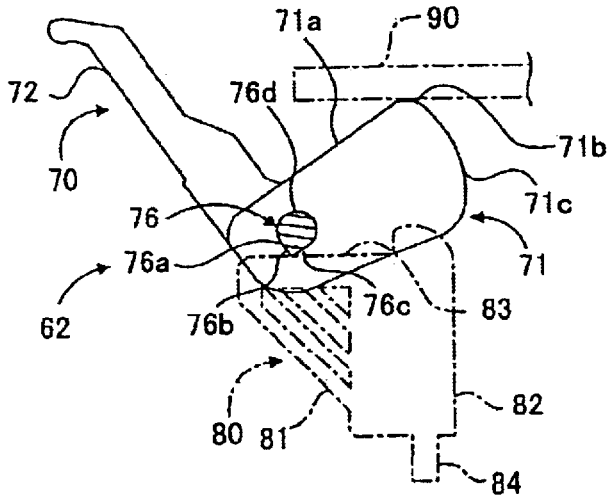
Figure 11C:
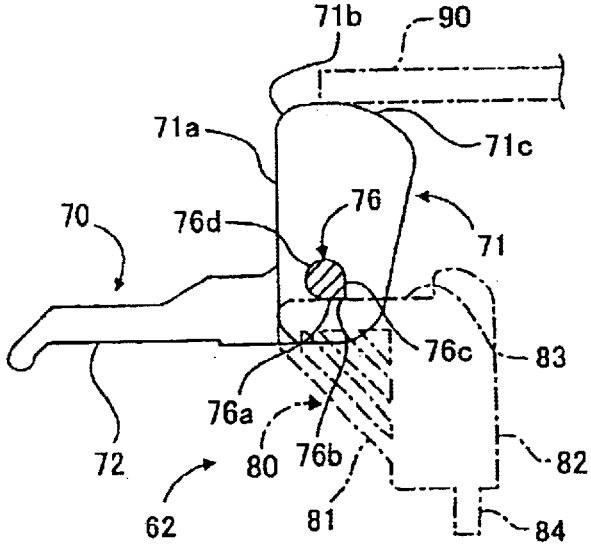

As shown in FIG. 11(*a*), the abutment plate 71 has a substantially rectangular shape and includes a first portion 71*a*, a first angled portion 71*b*, and a second portion 71*c* connected together in this order. The first portion 71*a* is a flat section formed at the upper end edge of the abutment plate 71. The second portion 71*c* is the front side edge of the abutment plate 71. The first angled portion 71*b* forms a rounded corner of the abutment plate 71 and connects the first portion 71*a* and the second portion 71*c*. The first portion 71*a* extends in the direction that is substantially perpendicular with the direction in which the second operation lever 72 extends. The second portion 71*c* is formed in an arched shape that follows the swing path followed by the abutment plate 71 when the abutment plate 71 swings about the swing shaft 76.

The swing shaft 76 is formed to protrude in an inward direction that intersects the abutment plate 71. The swing shaft 76 is formed in a substantial teardrop shape in cross section. The outer peripheral surface of the swing shaft 76 includes a third portion 76*c*, a fourth portion 76*a*, a second angle portion 76*b*, and a circular arched portion 76*d*. The third portion 76*c* and the fourth portion 76*a* are formed in a substantially flat shape. The second angle portion 76*b* is formed in an acute angle that connects one side of the third portion 76*c* and the fourth portion 76*a*. The circular arched portion 76*d* is formed in a circular arched shape that connects the other side of the third portion 76*c* and the fourth portion 76*a*. The third portion 76*c* is formed substantially parallel with the first portion 71*a* of the abutment plate 71.

The second operation lever 72 has a plate shape that can be manually manipulated. The second operation lever 72 is formed integrally with the abutment plate 71 so as to extend from the rear-side end of the abutment plate 71 in a direction that is substantially perpendicular to the abutment plate 71.

The slide member 80 has an integrally formed thick plate portion 81, a thin plate portion 82, and a protrusion portion 84. The thick plate portion 81 has a substantially triangular shape. The thick plate portion 81 is interposed between the pair of plate members of the protrusion portion 66 so as to be slidable vertically. An upper end 83 of the thick plate portion 81 is formed in a flat shape. The thin plate portion 82 is mounted within a through-hole type groove that is opened in the linear motion member 65 following the lengthwise direction of the linear motion member 65 and is also engaged, so as to be slidable vertically, in a slide groove formed in the rear-side end of the linear motion member 65. The protrusion portion 84 is formed at the lower end of the thin plate portion 82. The thick plate portion 81 of the slide member 80 is interposed between the plate members of the protrusion portion 66, and the thin plate portion 82 of the slide member 80 is guided in the through-hole type groove. Also, while the slide member 80 is interposed in the slide groove, the slide member 80 is slidable vertically up and down with respect to the linear movement rod 61.

As shown in FIG. 7, the second spring 63 is mounted in the through-hole type groove of the linear motion member 65 with the upper end of the second spring 63 engaged with the protrusion portion 84 of the slide member 80 and the lower end engaged with the abutment portion 65A of the linear motion member 65. The second spring 63 urges the slide member 80 and the abutment portion 65A to separate from each other. The elastic modulus of the second spring 63 is set smaller than the elastic modulus of the first spring 37.

The suspension spring 64 is attached at its lower end to the holding protrusion 65B and fixed at its upper end to the casing 2. The suspension spring 64 urges to pull the holding protrusion 65B upward. The elastic modulus of the suspension spring 64 is set smaller than the elastic modulus of the second spring 63.

For this reason, as shown in FIG. 7, the linear movement rod 38 is constantly urged by the suspension spring 64 so that the abutment plate 71 of the switch 62 abuts against a reference abutment portion 90 that is formed on the casing 2.

Next, operations of the pressure changing mechanism 60 will be explained. While the rear cover 58 is closed shut, then as shown in FIGS. 7 and 11(*a*), the second operation lever 72 is oriented in a substantially vertical posture. Because of this, the first portion 71*a* of the abutment plate 71 and the third portion 76*c* of the swing shaft 76 are oriented in substantially horizontal postures. In this condition, the linear movement rod 38 is urged upward by urging force of the suspension spring 64 so that the first portion 71*a* of the abutment plate 71 abuts against the lower surface of the reference abutment portion 90 and the abutment portion 65A is positioned in a non-operative position separated from the abutment lever 44 of the roller support member 36. This condition will be referred to as the non-operating condition, hereinafter. Accordingly, the roller support member 36 presses the pressing roller 27 against the thermal roller 26 under only the urging force of the first spring 37. Therefore, a predetermined pressing force is generated between the pressing roller 27 and the thermal roller 26. This will be referred to as a first pressing condition, hereinafter. In the non-operating condition, the thin plate portion 82 of the slide member 80 is urged by urging force of the second spring 63 to the upper portion of the slide groove. In this condition, the third portion 76*c* of the swing shaft 76 abuts the upper surface 63 of the thick plate portion 81. Also, at this time, as shown in FIG. 11(*a*) the first portion 71*a* of the abutment plate 71 abuts the lower surface of the reference abutment portion 90 and is maintained in that position. In this condition, printing is performed on thin sheets 3 made from normal paper, for example.

Figure 8:
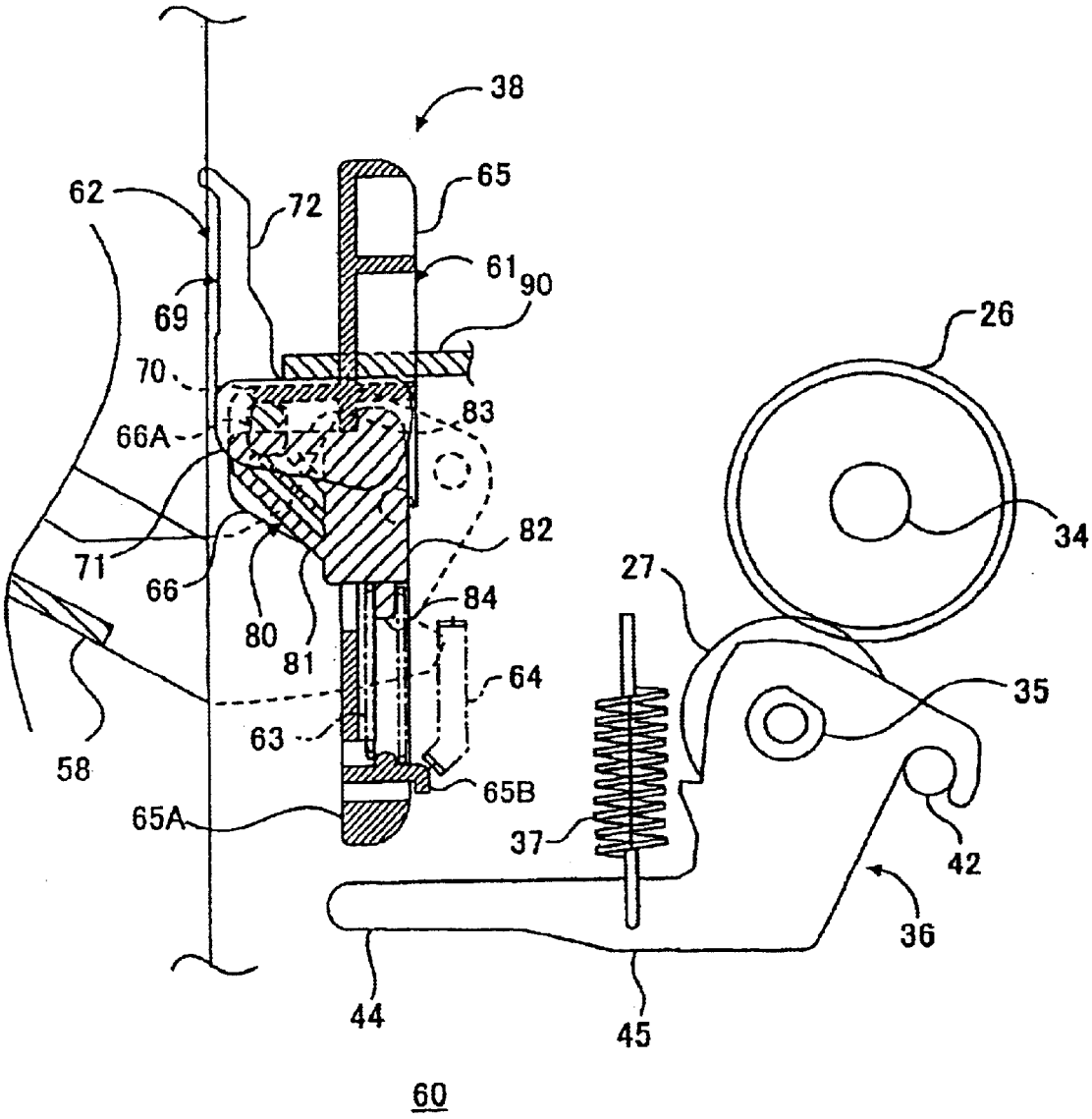
FIG. 8 is a magnified cross-sectional side view showing essential components of the pressing force adjusting mechanism of FIG. 7 with the rear cover in an opened condition and the second lever in the non-operating condition.

Next, when printing on a sheet 3 of relatively thick paper, such as a thick envelope, it is desirable to transport the sheet 3 substantially linearly from the fixing unit 18 in order to prevent the sheet 3 from being bent. For this reason, the rear cover 58 is opened up as shown in FIG. 8 from its closed condition. As a result, as shown in FIG. 1 a straight path is formed for discharging a sheet 3, onto which a toner image was thermally fixed by the fixing unit 18, onto the rear cover 58 in a substantially linear manner from the transport rollers 28, and also the second operation lever 72 is exposed.

If the user presses the second operation lever 72 downward and rearward in this condition, then the pressure between the thermal roller 26 and the pressing roller 27 is reduced from the pressure applied for printing on sheets 3 made from normal paper. That is, when the user presses the second operation lever 72 downward and rearward using his or her finger, then as shown in FIGS. 11(*b*) and 11(*c*) the second operation lever 72 swings downward around the swing shaft 76, and the abutment plate 71 swings upward around the swing shaft 76. At this time, first the first portion 71*a* of the abutment plate 71 abuts against the reference abutment portion 90 as shown in FIG. 11 (*a*). Then as swinging movement proceeds, then the second operation lever 72 enters temporarily into a slanted posture as shown in FIG. 11(*b*), whereby the first angled portion 71*b* of the second operation lever 72 abuts the reference abutment portion 90. When, the second operation lever 72 becomes oriented substantially horizontal as shown in FIG. 11(*c*). The second portion 71*c* abuts the reference abutment portion 90.

Also, at first as shown in FIG. 11(*a*) the third portion 76*c* of the swing shaft 76 abuts the upper surface 83 of the slide member 80. However, in the condition shown in FIG. 11(*b*) when the first angled portion 71*b* abuts the reference abutment portion 90, the second angle portion 76*b* abuts the upper surface 83. Afterward, in the condition shown in FIG. 11(*c*), when the second portion 71*c* abuts the reference abutment portion 90, the fourth portion 76*a* abuts the upper surface 83.

Figure 9:
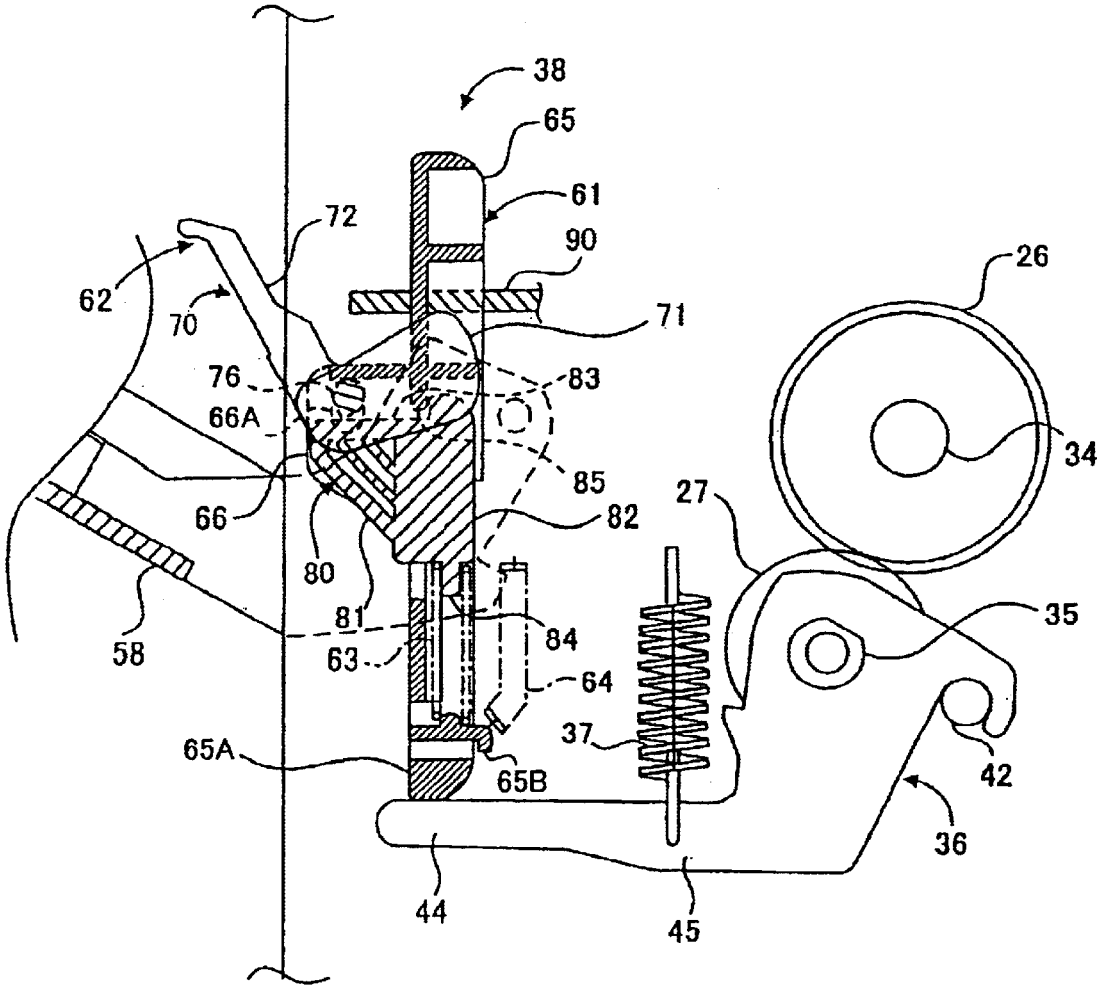
FIG. 9 is a magnified cross-sectional view from the side showing essential components of the pressing force adjusting mechanism of FIG. 7 with the rear cover in an opened condition and the second lever in position between the non-operating condition and an operating condition.

As a result, the swing shaft 76 moves downward only by the difference between the distance separating the second portion 71*c* from the swing shaft 76 and the distance separating the first portion 71*a* from the swing shaft 76. As a result, the slide member 80, which is abutted by the swing shaft 76, is also pressed down. Because the elastic modulus of the second spring 63 is larger than the elastic modulus of the suspension spring 64, as shown in FIG. 9 the linear movement rod 61 moves downward under the urging force of the second spring 63 so that the abutment portion 65A abuts the abutment lever 44 of the roller support member 36.

Figure 10:
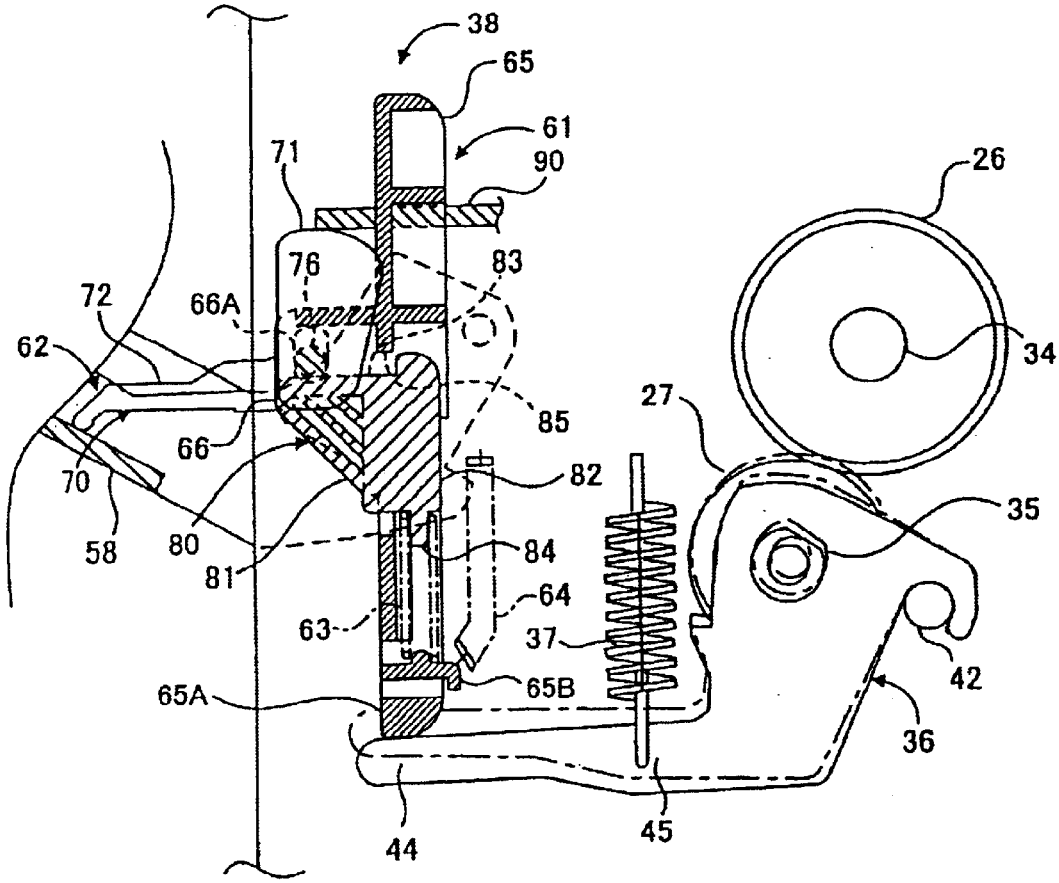
FIG. 10 is a magnified cross-sectional side view showing essential components of the pressing force adjusting mechanism of FIG. 7 with the rear cover in an opened condition and the second lever in the operating condition.

At this time, the abutment portion 65A receives upward moving repulsive force from the roller support member 36, which is urged by the first spring 37. However, because the elastic modulus of the first spring 37 is set larger than the elastic modulus of the second spring 63, the second spring 63 contracts under the repulsive force as shown in FIG. 10. Therefore, the linear movement rod 61 slidingly moves upward relative to the slide member 80, which is maintained in its position by the reference abutment portion 90. Therefore, substantially only the urging force of the second spring 63 operates to the roller support member 36 through the abutment portion 65A, without the abutment portion 65A pressing the roller support member 36 further downward. In the following explanation, the position where the abutment portion 65A abuts the abutment lever 44 will be referred to as the operation position, and the condition wherein only the urging force of the second spring 63 operates on the roller support member 36 in the direction against urging force of the first spring 37 will be referred to as the operating condition.

In the operation condition, the second spring 63 urges the roller support member 36 against the urging force of the first spring 37. Therefore, the roller support member 36 moves by a corresponding amount in the direction for releasing pressure between the pressing roller 27 and the thermal roller 26 so that pressure of the pressing roller 27 on the thermal roller 26 is reduced. As a result, a second pressure condition, wherein pressure applied to the thermal roller 26 is less than the predetermined pressing force, can be realized so that fixing operations can be properly performed on sheets 3 made from thick sheets, such as envelops.

In the pressure changing mechanism 60, the elastic modulus of the second spring 63 is set to a smaller value than the elastic modulus of the first spring 37. Therefore, in the operating condition the pressing force between the pressing roller 27 and the thermal roller 26 can be reliably reduced without completely releasing the pressing force between the thermal roller 26 and the pressing roller 27.

Once the user completes printing on thick sheets 3 and wants to print on normal sheets 3 of thinner print paper, then the user presses the second operation lever 72 up manually with his or her finger. As a result, the second operation lever 72 swings upward around the swing shaft 76 and the abutment plate 71 swings downward. As a result, the compression against the second spring 63 is released so that the urging force of the first spring 37 raises the linear movement rod 61 upward to separate from the abutment lever 44. Afterwards, the linear movement rod 61 is pulled upward by the urging force of the suspension spring 64 until the first portion 71*a* of the abutment plate 71 comes into abutment with the reference abutment portion 90. In this manner, components revert to the non-operating condition, that is, to the first pressing condition where the predetermined pressing force is generated between the pressing roller 27 and the thermal roller 26.

It should be noted that as the user presses the second operation lever 72 up, the abutment plate 71 changes from abutting the reference abutment portion 90 with the second portion 71*c* as shown in FIG. 11(*c*), to abutting the reference abutment portion 90 with the first angled portion 71*b* as shown in FIG. 11(*b*), and then to abutting the reference abutment portion 90 with the first portion 71*a*. Also, simultaneously with this, the swing shaft 76 changes from abutting the upper surface 83 of the slide member 80 with the fourth portion 76*a* as shown in FIG. 11(*c*), to abutting the upper surface 83 with the second angle portion 76*b* as shown in FIG. 11(*b*), and then to abutting the upper surface 83 with the third portion 76*c* as shown in FIG. 11(*a*).

Next, the user closes the rear cover 58 and prints using sheets 3 of normal paper. During printing, toner images are fixed on the sheets 3 by the predetermined pressure between the thermal roller 26 and the pressing roller 27 and discharged onto the discharge tray 31.

Here, if the laser printer 1 will not properly fix images onto normal sheets 3 if the user forgets to switch into the non-operating condition after printing on thick sheets 3 and before printing on normal sheets 3. However, in the embodiment, even if the user forgets to press the second operation lever 72 upward, the laser printer 1 will switch to the non-operating condition automatically when the rear cover 58 is closed shut. That is, in the operating condition shown in FIG. 10 the second operation lever 72 abuts against the inner surface of the rear cover 58. Therefore, when the rear cover 58 is closed shut, the second operation lever 72 presses against the second operation lever 72 and returns the second operation lever 72 into the non-operating condition. Accordingly, images can be properly fixed onto normal sheets 3.

In this way, by switching the second operation lever 72 into the non-operating condition, the pressing roller 27 presses the thermal roller 26 with the predetermined pressure in the first pressing condition. Therefore, images can be properly fixed onto normal sheets. On the other hand, by switching the second operation lever 72 into the operating condition, the pressing roller 27 will press against the thermal roller 26 in the second pressing condition with a pressing force that is smaller than the predetermined pressing force. Therefore, images can be properly formed on thick sheets, such as envelops.

Also, while the pressure changing mechanism 60 is in the operating condition, the linear movement rod 61 urges the roller support member 36 downward by only the urging force of the second spring 63. Therefore, the urging force applied by the first spring 37 to the roller support member 36 can be reduced by a fixed rate using a simple configuration so that the stable pressing force can be reliably reduced.

That is, when fixing images onto normal sheets 3 of paper, the pressing force between the pressing roller 27 and the thermal roller 26 can be designated by the urging force of only the first spring 37. Therefore, variation among laser printers in pressing force used to fix images on normal paper can be reduced compared to conventional printers that normally use two springs on each side of the pressing roller to generating pressing force during image fixation. Also, when fixing images onto thick sheets, the pressing force can be designated by the urging force of the first spring 37 and the urging force of the second spring 63, which operates against the urging force of the first spring 37. Therefore, variation among laser printers in the pressing force generated while fixing images onto thick sheets can be less than when the pressing force is switched by the stroke of a rod member as in the conventional technology.

Also, because the user can manually operate the second operation lever 72 to switch between the operating condition and the non-operating condition, this switching operation can be performed reliably at any desired time.

While the abutment portion 65A is in the operating position, the position of the slide member 80 is regulated by the abutment plate 71, whose position is constantly restricted by the reference abutment portion 90. Therefore, the position of the slide member 80 can be properly regulated using a simple configuration. By attaching the second spring 63 to the slide member 80, the urging force of the second spring 63 against the roller support member 36 can be reliably stable.

The first angled portion 71*b* is formed between the first portion 71*a* and the second portion 71*c*. Therefore, the abutment plate 71 will always swing into abutment with the reference abutment portion 90 by either the second portion 71*c* or the first portion 71*a*. That is, even though the first angled portion 71*b* abuts against the reference abutment portion 90 while the second operation lever 72 is being switched between the operating condition and the non-operating condition, the condition is not stable so the abutment plate 71 will swing one way or the other. For this reason, the second operation lever 72 stably supports the abutment portion 65A in the operating condition so that the switching operation is more reliably and stably performed.

Furthermore, the second portion 71*c* is formed with an arched shape that follows the swinging path of the abutment plate 71. Therefore, the second operation lever 72 will swing smoothly when the linear movement rod 61 is switched from the operating position to the non-operating position by the second operation lever 72. For this reason, the switching operation can be even more reliably and stably performed.

Further, the second angle portion 76*b* is formed between the third portion 76*c* and the fourth portion 76*a* of the swing shaft 76 of the abutment plate 71. Therefore, even if the second angle portion 76*b* abuts against the slide member 80, the condition is unstable so the swing shaft 76 will rotate to abut the slide member 80 with either the third portion 76*c* or the fourth portion 76*a*. For this reason, the linear movement rod 61 is stably held in either the non-operating position or the operating position. Therefore, the switching operation can be even more reliably and stably performed.

Also, the second operation lever 72 swings centered around the swing shaft 76. Therefore, by forming the swing shaft 76 to such a shape, the second operation lever 72 can be switched smoothly with only a light force. Therefore, the switching operation can be even more stably performed.

Although the embodiment describes a pressure changing mechanism 60 as being provided to both sides of the fixing unit 18, even if one is in the operating condition and the other is in the non-operating condition, pressing force that prevents paper jams can be set without obstructing the passage of sheets.

While some exemplary embodiments of this invention have been described in detail, those skilled in the art will recognize that there are many possible modifications and variations which may be made in these exemplary embodiments while yet retaining many of the novel features and advantages of the invention.

For example, only a single pressure changing mechanism 60 could be provided for moving the entire pressing roller 27 with respect to the thermal roller 26.

What is claimed is:

1. An image forming device comprising:

a fixing unit including two fixing members disposed in pressable confrontation with each other, the fixing unit fixing images onto a recording medium sandwiched between the fixing members;

a pressing force adjusting mechanism that adjusts pressing force applied between the fixing members, wherein the pressing force adjusting mechanism includes:

a first urging unit that urges the fixing members to press against each other;

a second urging unit including a first resilient member that produces an urging force that reduces the pressing force between the fixing members against an urging force of the first urging unit, the second urging unit being switchable between an operating mode wherein the urging force of the first resilient member operates to reduce the pressing force between the fixing members and a non-operating mode wherein the urging force of the first resilient member does not operate to reduce the pressing force between the fixing members;

a casing; and a first cover that is disposed to a side of the casing and movable between an opened-up condition and a closed condition, the first cover in the opened-up condition enabling the recording medium to be linearly transported from the fixing unit out of the casing, the first cover switching the second urging unit from the operating mode to the non-operating mode when the first cover closes from the opened-up condition.

2. The image forming device according to claim 1, wherein the second urging unit is provided capable of manipulation.

3. The image forming device according to claim 1, wherein the fixing members are rollers, and the first urging unit includes:

a movable support member that supports one of the rollers movable into and out of a pressing condition with the other roller; and a second resilient member that urges the movable support member to press the roller in the direction toward the other roller; and the second urging unit in the operating mode applies urging force of the first resilient member on the movable support member to reduce the pressing force between the fixing members.

4. The image forming device according to claim 3, wherein the first resilient member of the second urging unit has a smaller resiliency than the second resilient member of the first urging unit.

5. The image forming device according to claim 3, wherein the second urging unit includes:

an abutment member that abuts the movable support member; and a switching member that switches the abutment member between an operating position and a non-operating position, wherein the abutment member in the operating position abuts the movable support member, thereby reducing the pressing force between the fixing member; and the first resilient member urges the abutment member and the switching member to separate from each other.

6. The image forming device according to claim 5, wherein the switching member includes a slide member capable of moving relative to the abutment member, and an abutment plate that regulates the position of the slide member when the abutment member is in the operating position.

7. The image forming device according to claim 5, further comprising a fixed member, wherein the abutment plate is swingably supported on the abutment member and abuts the fixed member, the abutment plate including:

a first portion that abuts the fixed member when the abutment member is in the non-operating position;

a second portion that abuts the casing when the abutment member is in the operating position; and a first connection portion connecting the first and second portions together.

8. The image forming device according to claim 7, wherein the second portion has an arched shape that follows a swinging path followed by the abutment plate.

9. The image forming device according to claim 7, further comprising a swing shaft that supports the abutment plate swingable with respect to the abutment member, the swing shaft including:

a third portion that abuts the slide member when the abutment member is in the non-operating position;

a fourth portion that abuts the slide member when the abutment member is in the operating position; and a second connection portion connecting the third and fourth portions together.

10. The image forming device according to claim 9, wherein the second connection portion is formed in an acute angle.

11. The image forming device according to claim 5, further comprising:

a casing; and a first cover that is disposed to a side of the casing and movable between an opened-up condition and a closed condition, the first cover in the opened-up condition enabling the recording medium to be linearly transported from the fixing unit out of the casing, the first cover switching the second urging unit from the operating mode to the non-operating mode when the first cover closes from the opened-up condition, wherein the switching member includes a manipulation lever capable of being manipulated, the manipulation lever being abutted by the first cover, and moving the abutment member from the operating position to the non-operating position when the first cover is closed shut from the opened-up condition.

12. The image forming device according to claim 5, further comprising:

a second cover that is movably between an opened-up condition and a closed condition; and a linking mechanism that links between the second cover and the abutment member, wherein when the second cover opens up from the closed condition, the linking mechanism presses the abutment member, against urging force of the first urging unit, to move the movable support member to a pressure release position, thereby releasing the pressing contact between the fixing members.

13. The image forming device according to claim 12, further comprising:

a casing; and a first cover that is disposed to a side of the casing and movable between an opened-up condition and a closed condition, the first cover in the opened-up condition enabling the recording medium to be linearly transported from the fixing unit out of the casing, the first cover switching the second urging unit from the operating mode to the non-operating mode when the first cover closes from the opened-up condition, wherein wherein the second cover is disposed on the top of the casing and formed separately from the first cover.

14. An image forming device comprising:

a casing:

a fixing unit including two fixing members disposed in pressable confrontation with each other, the fixing unit fixing images onto a recording medium sandwiched between the fixing members;

a pressing force adjusting mechanism including a pressing member that selectively applies a predetermined pressing force and a smaller pressing force between the fixing members, and a switching member that switches the pressing member between a first pressing condition for applying the predetermined pressing force between the fixing members and a second pressing condition for applying the smaller pressing force between the fixing members; and a cover that selectively opens up and covers interior of the casing, the cover in the opened-up condition enabling the recording medium to be linearly transported from the fixing unit out of the casing, the first pressing condition being maintained when the cover is opened, the switching member being operated to switch the pressing member from the first pressing condition to the second pressing condition after the cover is opened.

15. The image forming device according to claim 14, wherein the pressing member includes a first urging member and a second urging member, the pressing member applying the predetermined pressing force between the fixing members using only the first urging member, the pressing member applying the smaller pressing force between the fixing members using both the first and second urging members.

16. The image forming device according to claim 15, wherein the first urging member has a greater resiliency than the second urging member.

* * * * *